US008727679B2

(12) United States Patent
Evatt

(10) Patent No.: US 8,727,679 B2
(45) Date of Patent: May 20, 2014

(54) WOOD BORING BIT

(75) Inventor: Thomas Evatt, Six Mile, SC (US)

(73) Assignee: Techtronic Power Tools Technology Limited, Tortola (VG)

( * ) Notice: Subject to any disclaimer, the term of this patent is extended or adjusted under 35 U.S.C. 154(b) by 923 days.

(21) Appl. No.: 12/878,524

(22) Filed: Sep. 9, 2010

(65) Prior Publication Data

US 2011/0085866 A1 Apr. 14, 2011

Related U.S. Application Data

(60) Provisional application No. 61/241,333, filed on Sep. 10, 2009.

(51) Int. Cl.
*B27G 15/00* (2006.01)

(52) U.S. Cl.
USPC ..... 408/211; 408/213; 408/227

(58) Field of Classification Search
USPC ..... 408/227–230, 211–214, 224, 225
IPC ..... B27G 15/00,15/02
See application file for complete search history.

(56) References Cited

U.S. PATENT DOCUMENTS

| | | | | |
|---|---|---|---|---|
| 199,391 | A | | 1/1878 | Wissinger |
| 762,099 | A | | 6/1904 | Sperry |
| 1,185,380 | A | | 5/1916 | Davis |
| 1,444,626 | A | | 2/1923 | Maxim |
| 1,655,836 | A | | 1/1928 | Hawkinson |
| 1,910,143 | A | | 5/1933 | Arenz |
| 1,966,176 | A | | 7/1934 | Knapp |
| 2,264,922 | A | | 12/1941 | Van Hooser |
| 2,883,888 | A | | 4/1959 | Stewart |
| 3,610,768 | A | | 10/1971 | Cochran |
| 4,012,970 | A | * | 3/1977 | Hintz et al. ..... 76/102 |
| 4,134,706 | A | | 1/1979 | Stewart |
| 4,239,427 | A | | 12/1980 | Walton, II |
| 4,244,667 | A | | 1/1981 | Timmons |
| 4,753,558 | A | | 6/1988 | Jansson |
| 4,850,758 | A | | 7/1989 | Morgan |
| 5,092,719 | A | | 3/1992 | Zsiger |
| 5,193,951 | A | | 3/1993 | Schimke |

(Continued)

FOREIGN PATENT DOCUMENTS

| | | | | |
|---|---|---|---|---|
| DE | 2636182 | A | * | 2/1978 |
| DE | 2842423 | A | * | 4/1980 |

(Continued)

*Primary Examiner* — Daniel Howell
(74) *Attorney, Agent, or Firm* — Michael Best & Friedrich LLP

(57) ABSTRACT

A boring bit includes a shank and a drilling head coupled to the shank. The drilling head includes a center tip and a pair of flanges. Each flange includes a cylindrical sidewall section, a cutting edge extending radially outward from the center tip to the sidewall section, a bottom face extending radially outward from the shank to the sidewall section, a rake face extending axially from the cutting edge to the bottom face, a rearward edge extending radially outward from the shank to the sidewall section and defining a boundary of the bottom face opposite the rake face, a spur extending axially from the sidewall section, and a chip channel defined at least in part by the sidewall section. The sidewall section of each flange extends through a sweep angle from the cutting edge to the rearward edge. The sweep angle is between about 30 degrees and about 60 degrees.

17 Claims, 5 Drawing Sheets

(56) References Cited

U.S. PATENT DOCUMENTS

| | | | |
|---|---|---|---|
| 5,312,207 | A | 5/1994 | Pomp |
| 5,466,100 | A | 11/1995 | Ahluwalia |
| 5,695,304 | A | 12/1997 | Ebert |
| 5,975,814 | A | 11/1999 | Pomp |
| 6,045,302 | A | 4/2000 | Orr |
| D442,192 | S | 5/2001 | Strong |
| 6,354,773 | B1 | 3/2002 | Konen |
| 6,354,774 | B1 | 3/2002 | Haughton et al. |
| 6,394,714 | B2 | 5/2002 | Eberhard |
| 6,431,801 | B2 | 8/2002 | Vasudeva et al. |
| 6,499,919 | B2 | 12/2002 | Feld |
| 6,612,788 | B2 | 9/2003 | Thomas et al. |
| 6,644,899 | B2 | 11/2003 | Ebehard |
| 6,652,202 | B2 | 11/2003 | Remke et al. |
| 6,874,978 | B2 | 4/2005 | Gongola |
| 6,986,627 | B2 | 1/2006 | Feld |
| 7,152,509 | B2 | 12/2006 | McCalley, Jr. et al. |
| D575,808 | S | 8/2008 | Zeiler et al. |
| 7,625,160 | B2 | 12/2009 | Zeiler et al. |
| 2002/0141838 | A1 | 10/2002 | Thomas et al. |
| 2003/0068208 | A1 | 4/2003 | Eberhard |
| 2004/0156689 | A1 | 8/2004 | Shen |
| 2007/0172325 | A1 | 7/2007 | Ebert |
| 2007/0277656 | A1 | 12/2007 | Zeiler et al. |
| 2007/0280798 | A1 | 12/2007 | Zeiler et al. |
| 2008/0050190 | A1 | 2/2008 | Miebach |
| 2009/0142152 | A1 | 6/2009 | Liao et al. |
| 2011/0085866 | A1 | 4/2011 | Evatt |

FOREIGN PATENT DOCUMENTS

| | | | | |
|---|---|---|---|---|
| DE | 3738000 | | | 5/1989 |
| EP | 976492 | A1 | * | 2/2000 |
| GB | 193786 | A | * | 3/1923 |
| GB | 194542 | A | * | 3/1923 |
| JP | 07001407 | A | * | 1/1995 |

* cited by examiner

WOOD BORING BIT

CROSS-REFERENCE TO RELATED APPLICATIONS

This application claims priority to U.S. Provisional Patent Application No. 61/241,333, filed Sep. 10, 2009 by Thomas Evatt and titled, "WOOD BORING BIT," the entire contents of which are hereby incorporated by reference.

BACKGROUND OF THE INVENTION

The present invention relates to tools and, more particularly, to wood boring tools.

Forstner bits, also known as Forstner flange bits or webfoot augers, bore precise, flat-bottomed holes in wood. The bits may also cut on an edge of a work piece or cut overlapping holes. The bit includes a drilling head having a center point or tip that guides the head during a cut. The drilling head has a generally cylindrical shape around its perimeter that defines a diameter of the bit, shears the wood at the edge of the hole and helps precisely guide the bit into the wood. The bit further includes two radial cutting edges to plane off material at a bottom of the hole.

Current types of Forstner bits include a large mass that defines the drilling head of the bit. The drilling head sweeps through a relatively large angle leaving relatively small openings. The small openings inhibit the user's view through the bit. As the bit rotates, the drilling head makes it difficult for a user to see the bottom of the hole being bored. The small openings also limit chip removal from the hole.

SUMMARY OF THE INVENTION

In one construction, the invention provides a boring bit including a shank having a first end and a second end. The shank defines a longitudinal axis extending through the first end and the second end. The boring bit also includes a drilling head coupled to the first end of the shank coaxial with the longitudinal axis. The drilling head includes a center tip extending axially along the longitudinal axis and a pair of flanges extending radially outward from the center tip. Each flange includes a cylindrical sidewall section, a cutting edge extending radially outward from the center tip to the cylindrical sidewall section, a bottom face extending radially outward from the first end of the shank to the cylindrical sidewall section, a rake face extending axially from the cutting edge to the bottom face, a rearward edge extending radially outward from the first end of the shank to the cylindrical sidewall section and defining a boundary of the bottom face opposite the rake face, a spur spaced from the longitudinal axis and extending axially from the cylindrical sidewall section, and a chip channel defined at least in part by the cylindrical sidewall section to direct cut material away from the cutting edge and toward the shank. The cylindrical sidewall section of each flange extends through a sweep angle from the cutting edge to the rearward edge. The sweep angle is between about 30 degrees and about 60 degrees.

In another construction, the invention provides a boring bit including a shank having a first end and a second end. The shank defines a longitudinal axis extending through the first end and the second end. The boring bit also includes a drilling head coupled to the first end of the shank coaxial with the longitudinal axis. The drilling head includes a center tip extending axially along the longitudinal axis and a pair of flanges extending radially outward from the center tip. Each flange includes a cylindrical sidewall section, a cutting edge extending radially outward from the center tip to the cylindrical sidewall section, a bottom face extending radially outward from the first end of the shank to the cylindrical sidewall section, a rake face extending axially from the cutting edge to the bottom face, a rear face extending radially outward from the first end of the shank to the cylindrical sidewall section and extending axially from the bottom face away from the first end of the shank, a spur spaced from the longitudinal axis and extending axially from a portion of the cylindrical sidewall section, and a chip channel defined at least in part by the cylindrical sidewall section to direct cut material away from the cutting edge and toward the shank. The cylindrical sidewall section of each flange is generally smooth and continuous between the rake face and the rear face. The cylindrical sidewall section of each flange extends through between about 8% and about 17% of a total circumference of the drilling head.

In yet another construction, the invention provides a boring bit including a shank having a first end and a second end. The shank defines a longitudinal axis extending through the first end and the second end. The boring bit also includes a drilling head coupled to the first end of the shank coaxial with the longitudinal axis. The drilling head includes a center tip extending axially along the longitudinal axis and a pair of flanges extending radially outward from the center tip. Each flange includes a cylindrical sidewall section, a cutting edge extending radially outward from the center tip to the cylindrical sidewall section, a bottom face extending radially outward from the first end of the shank to the cylindrical sidewall section, a rake face extending axially from the cutting edge to the bottom face, a trailing edge spaced from the cutting edge and extending radially outward from the center tip, a cutting face extending between the cutting edge and the trailing edge, a relief face extending circumferentially away from the cutting face along the cylindrical sidewall section, a rear face extending radially outward from the first end of the shank to the cylindrical sidewall section and extending axially from the bottom face to the relief face, a rearward edge extending radially outward from the first end of the shank to the cylindrical sidewall section through an intersection of the bottom face and the rear face, a spur spaced from the longitudinal axis and extending axially from the relief face, and a chip channel defined at least in part by the cylindrical sidewall section to direct cut material away from the cutting edge and toward the shank. The cylindrical sidewall section of each flange is generally smooth and continuous between the rake face and the rear face. The cylindrical sidewall section of each flange extends through a sweep angle from the cutting edge to the rearward edge. The sweep angle is between about 30 degrees and about 60 degrees such that the cylindrical sidewall section of each flange extends through between about 8% and about 17% of a total circumference of the drilling head.

Other aspects of the invention will become apparent by consideration of the description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
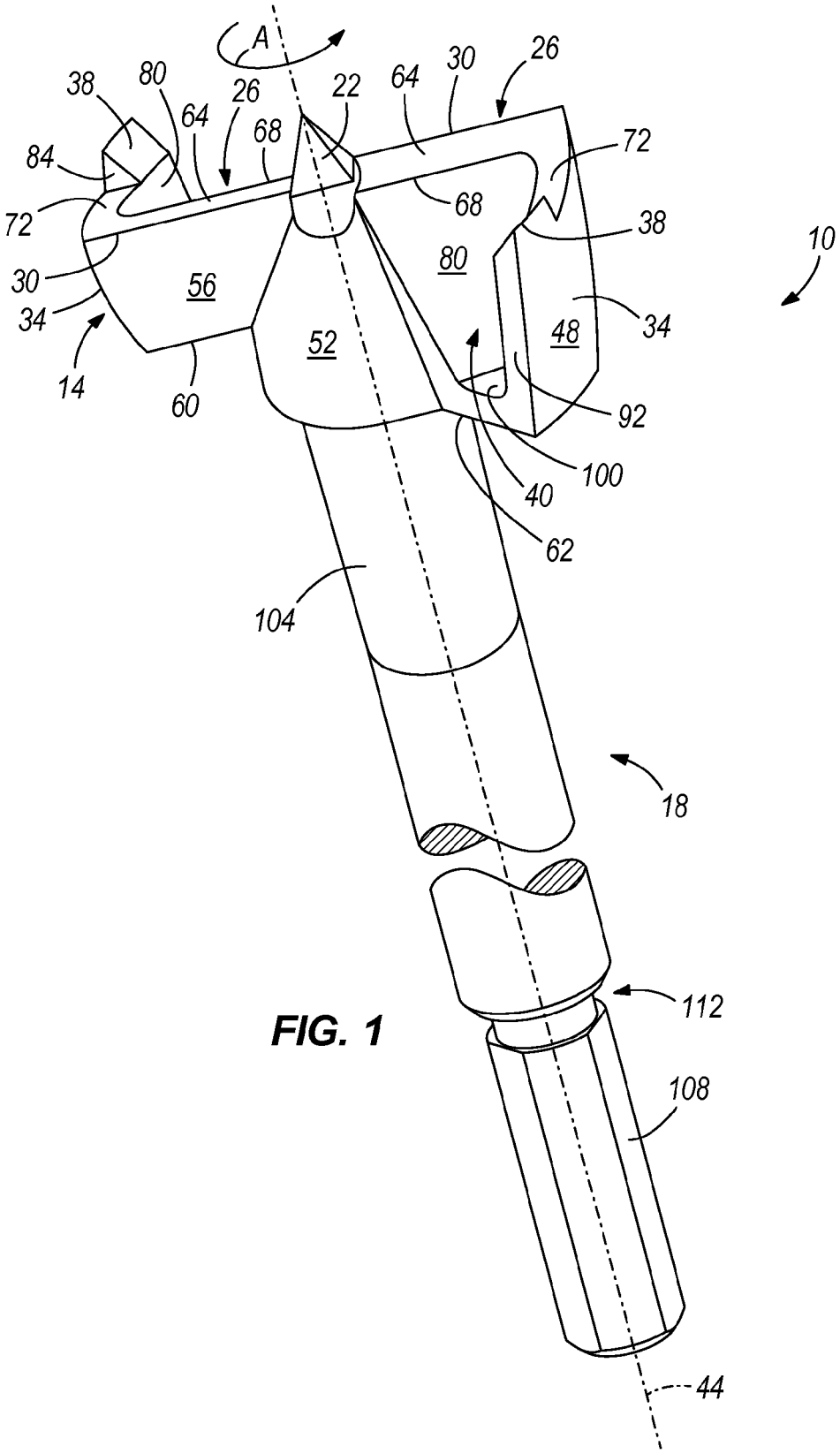
FIG. 1 is a perspective view of a wood boring bit according to one construction of the invention.

FIG. 1 illustrates a Forstner-type wood boring bit 10 for releasable connection to a rotary power tool (not shown), such as, for example, a drill. In further constructions, the bit 10 may be modified for use with other types of materials, such as plastic or metal. The bit 10 includes a drilling head 14 and a shank 18 coupled to and extending axially from the head 14. In the illustrated construction, the drilling head 14 and the shank 18 are integrally formed as a single piece. In other constructions, the drilling head 14 and the shank 18 may be separate pieces that are securely fixed (e.g., welded, brazed, etc.) together.

Figure 2:
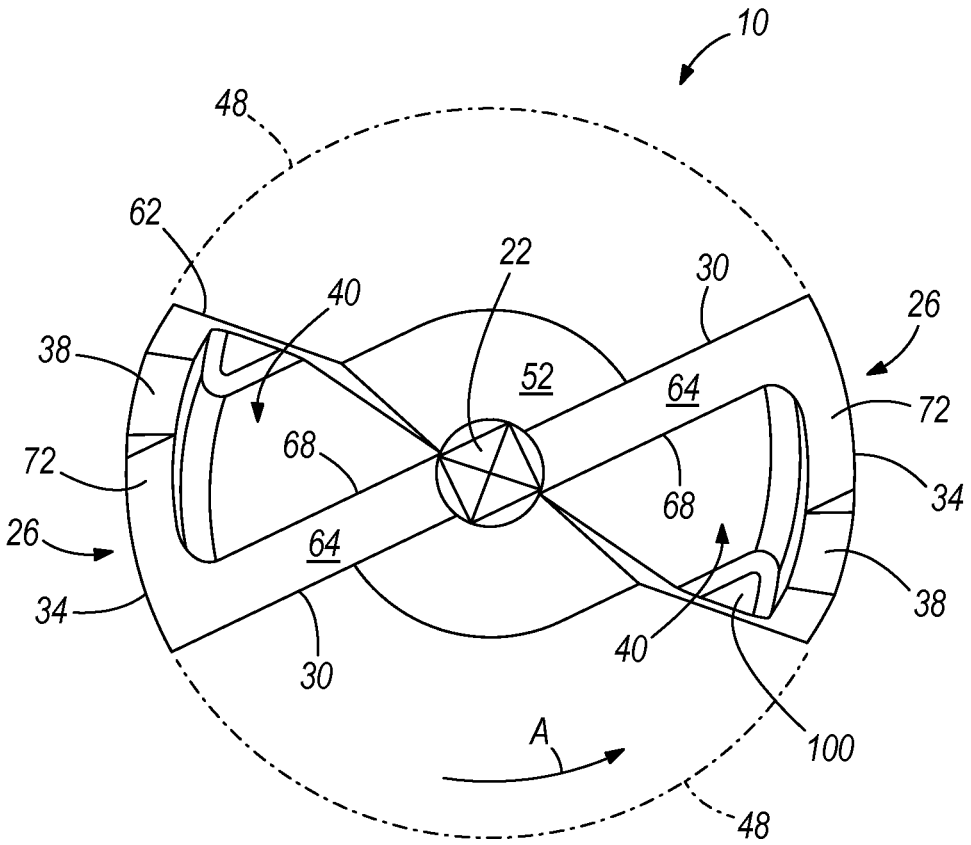
FIG. 2 is a top view of the wood boring bit shown in FIG. 1.

As shown in FIGS. 1 and 2, the drilling head 14 includes a center tip 22 and two radially extending cutting flanges 26. Each of the cutting flanges 26 includes a cutting edge 30, a section 34 of a cylindrical sidewall 48, a spur 38, and a chip channel 40. In operation, the drilling head 14 rotates in direction A about a longitudinal axis 44 that runs through a center of the drilling head 14. Referring to FIGS. 2-5, the drilling head 14 is bounded by the cylindrical sidewall 48, a first or upper plane B, and a second or lower plane C. The planes B, C are parallel to each other and normal to the cylindrical sidewall 48. Also shown in FIG. 2 is a phantom extension of the cylindrical sidewall 48, which further defines the periphery and diameter of the drilling head 14.

The illustrated center tip 22 has a generally pyramidal shape that extends axially from a center portion 52 of the drilling head 14. The center tip 22 is centered about the longitudinal axis 44 such that the tip 22 extends along the axis 44.

Figure 4:
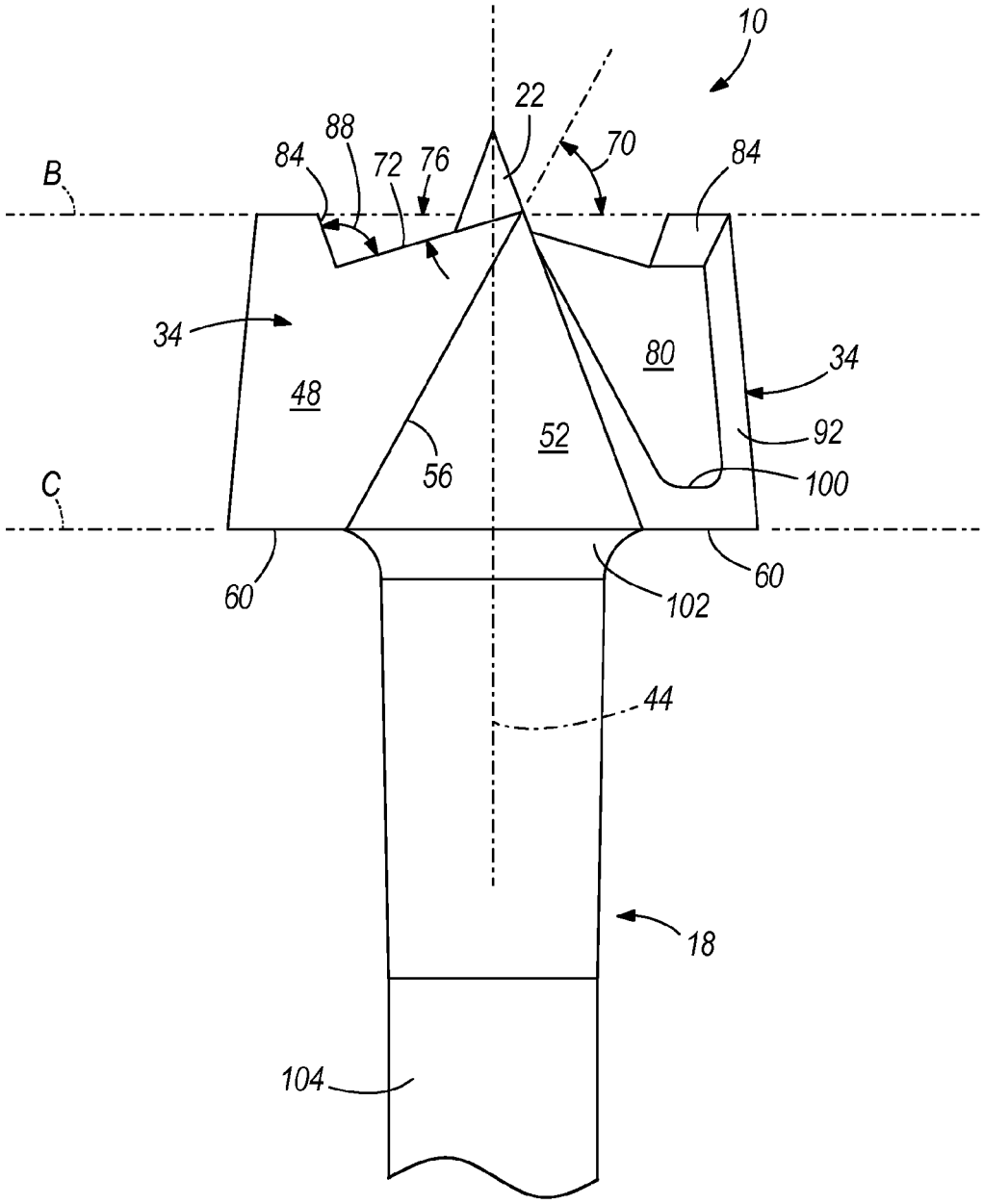
FIG. 4 is a second, enlarged side view of the wood boring bit shown in FIG. 1.

The cutting edges 30 extend generally radially outward from the center tip 22 to the corresponding cylindrical sidewall sections 34. In the illustrated construction, the cutting edges 30 generally lie within the plane B. A rake face 56 extends axially from each of the cutting edges 30 to a bottom face 60 of the drilling head 14. As shown in FIGS. 1 and 4, the illustrated rake faces 56 are generally planar and oriented at an oblique rake angle 70 relative to the plane B. In the illustrated construction, the rake angle 70 is between about 52° and about 72°.

Figure 6:
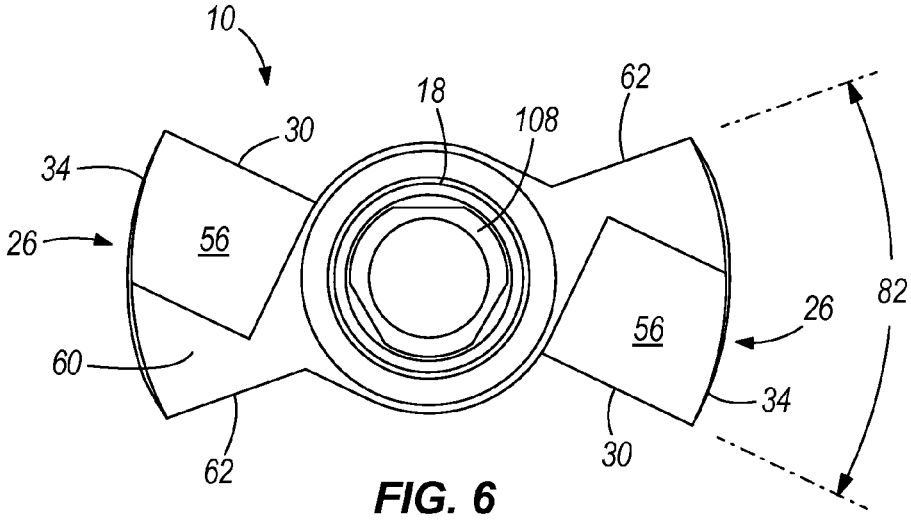
FIG. 6 is a bottom view of the wood boring bit shown in FIG. 1.

As shown in FIGS. 1 and 6, each flange 26 also includes a rearward edge 62 extending generally radially outward from the shank 18 to the cylindrical sidewall sections 34. The rearward edges 62 are defined by the intersection of a rear face 92 and the bottom face 60 of each flange 26. Each rearward edge 62 thereby defines a boundary of the corresponding bottom face 60 opposite the rake face 56.

As shown in FIGS. 1 and 2, each of the cutting flanges 26 includes a cutting face 64 that extends rearwardly (i.e., in a direction generally opposite the rotation direction A) from the respective cutting edge 30. Each of the cutting faces 64 is bounded opposite the respective cutting edges 30 by a trailing edge 68. The trailing edge 68 of each flange 26 is spaced from the corresponding cutting edge 30 and extends radially outward from the center tip 22, generally parallel to the cutting edge 30.

As shown in FIGS. 1-4, each of the cutting flanges 26 includes a relief face 72. Each relief face 72 extends circumferentially away from the corresponding cutting face 64 along the cylindrical sidewall section 34. The illustrated relief faces 72 are oriented at a relief angle 76 (FIG. 4) relative to the plane B. In the illustrated construction, the relief angle 76 is between about 12° and about 21°.

Figure 5:
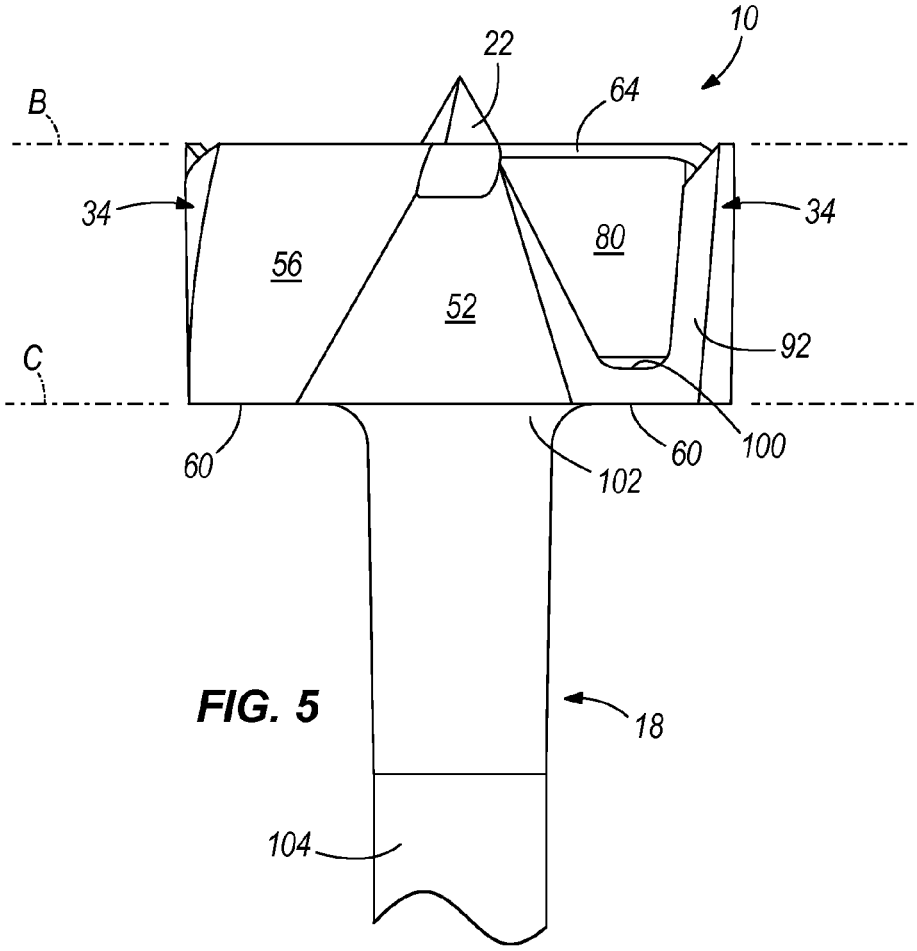
FIG. 5 is a front view of the wood boring bit shown in FIG. 1.

As shown in FIGS. 1 and 4-5, a trailing surface 80 extends axially from at least each of the trailing edges 68 of the cutting faces 64. The trailing surface 80 extends away from the center tip 22 to a floor section 100 of the drilling head 14. In the illustrated construction, the trailing surface 80 also extends from the relief face 72.

FIG. 6 is a view of the drill bit 10 normal to the longitudinal axis 44. As shown in FIG. 6, each section 34 of the cylindrical sidewall 48 extends through a sweep angle 82. The sweep angle 82 is defined by the cutting edge 30 and the rearward edge 62 of each flange 26. In some constructions, the sweep angle 82 may be between about 30° and about 60° such that each cylindrical sidewall section 34 extends through between about 8% and about 17% of a total circumference (identified by the phantom line extensions of the sidewall 48 shown in FIG. 2) of the drilling head 14. In the illustrated construction, the sweep angle 82 is about 55° such that each cylindrical sidewall section 34 extends through about 15% of the total circumference of the drilling head 14. The relatively small sweep angle 82 allows for improved user visibility of the cutting edges 30 and hole being bored as the bit 10 rotates during operation. In addition, the relatively small sweep angle 82 improves chip removal since each flange 26 takes up relatively less volume compared to conventional Forstner bits. In further constructions, a smaller or larger sweep angle 82 is possible, as long as the drilling head 14 includes at least one spur 38 on each cutting flange 26, at least two cutting edges 30, and provides for improved operator visibility.

As shown in FIG. 4, each of the spurs 38 extends toward the plane B of the drilling head 14 from the relief faces 72 of the cylindrical sidewall sections 34. Each spur 38 includes a forward face 84 (i.e., the face of the spur 38 nearest the cutting edge 30). The forward face 84 of each spur 38 is oriented at a spur angle 88 relative to the corresponding relief face 72. In the illustrated construction, the spur angle 88 is between about 88° and about 98°. The illustrated spurs 38 share the rear faces 92 with the cylindrical sidewall sections 34.

Figure 3:
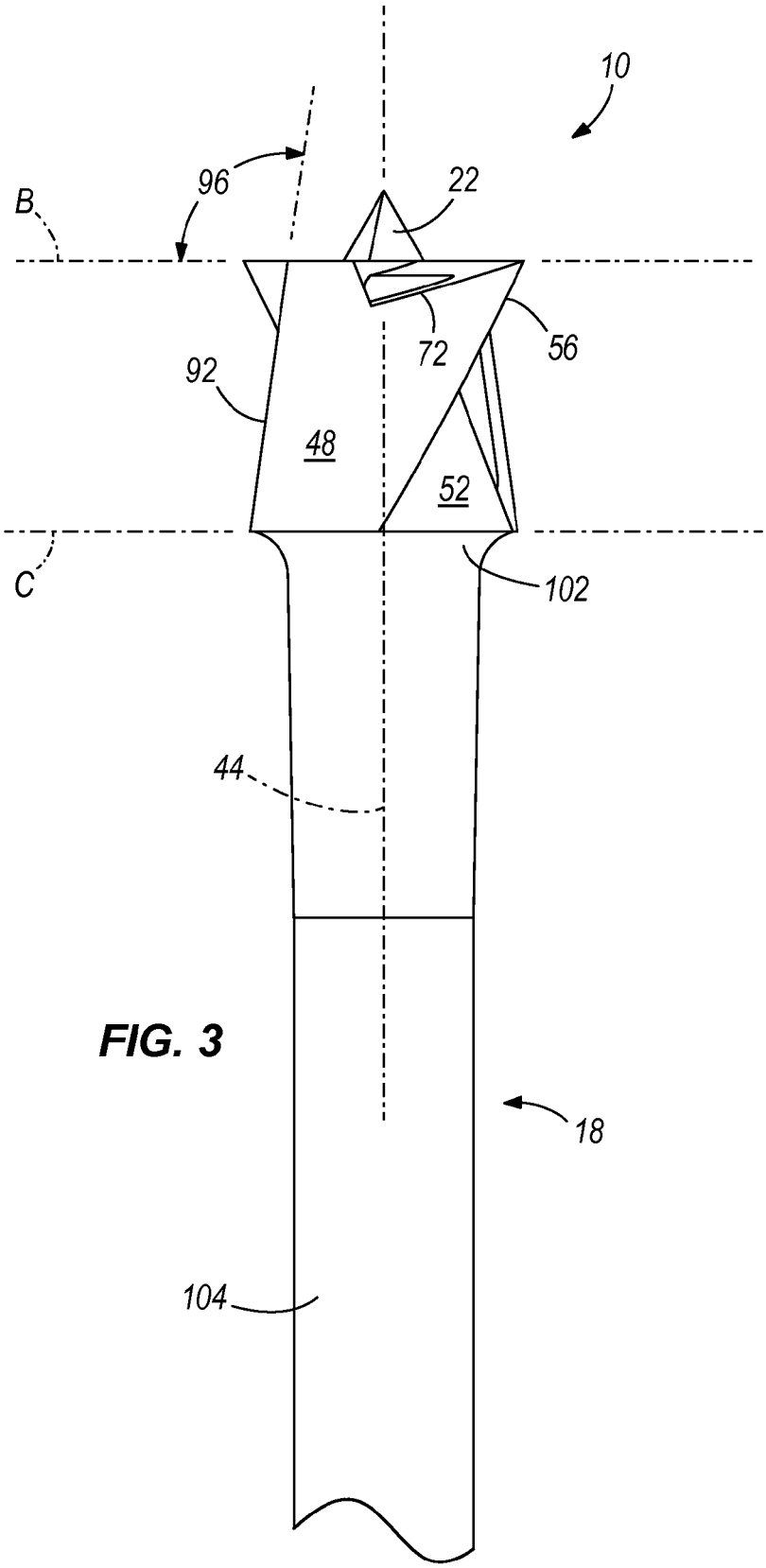
FIG. 3 is a first side view of the wood boring bit shown in FIG. 1.

Referring to FIG. 3, the rear face 92 of each of the cylindrical sidewall sections 34 is generally planar and is oriented at a rear face angle 96 relative to the plane B. In the illustrated construction, the rear face angle 96 is between about 90° and about 105°.

In the illustrated construction, the cylindrical sidewall section 34 of each flange 26 is generally smooth and continuous between the corresponding rake face 56 and the corresponding rear face 92. As used herein, the cylindrical sidewall sections 34 are defined as being 'smooth and continuous' because there are no breaks, recesses, protrusions, or other interruptions formed or machined in the outer surface of the sidewall 48. Such a construction helps create a smooth bore in a work piece during operation of the boring bit 10.

Referring back to FIG. 1, each chip channel 40 is defined by the conjunction of the trailing face 80, the cylindrical sidewall sections 34, and, in some constructions, the floor section 100. The floor section 100 forms the bottom face 60 of the drilling head 14 such that the bottom face 60 is generally planar. The chip channels 40 direct cut material away from the cutting edges 30 and toward the shank 18 to facilitate chip removal from the drilling head 14 and hole being bored during operation of the bit 10.

The shank 18 extends from the bottom face 60 of the drilling head 14 on a side opposite the center tip 22. The illustrated shank 18 includes a mounting portion 102 (FIGS. 3-5), a cylindrical portion 104, and a connecting portion 108. The shank 18 also defines the longitudinal axis 44, which extends through the mounting portion 102, the cylindrical portion 104, and the connecting portion 108. As shown in FIGS. 3-5, the mounting portion 102 is located at a first or proximal end of the shank 18 and is coupled to the drilling head 14. As shown in FIG. 1, the cylindrical portion 104 extends between the mounting portion 102 and the connecting portion 108. The connecting portion 108 is located at a second or distal end of the shank 18 and couples to a power tool (e.g., a drill). In the illustrated construction, the connecting portion 108 includes three flats and defines a circumferential groove 112 for mounting in a chuck of the power tool. In other constructions, the connecting portion 108 may include fewer or more flats such that the connecting portion 108 may be, for example, a hex-shaped portion. In further constructions, other known types of shanks may be used for releasably coupling the bit 10 to a power tool.

The illustrated wood boring bit 10 is operable to be chucked about the shank 18 in a power tool and rotated in direction A by the tool. The center tip 22, the spurs 38, and the cylindrical sidewall sections 34 keep the bit 10 centered, while the cutting edges 30 remove wood or other material being bored from a work piece (not shown). The chip channels 40 direct removed material away from and out of the bit 10. The spurs 38 also remove material from the work piece and help maintain the cutting edges 30 at a consistent cutting angle relative to the work piece.

Although particular constructions embodying independent aspects of the present invention have been shown and described, other alternative constructions will become apparent to those skilled in the art and are within the intended scope of the independent aspects of the invention. Various features and advantages of the invention are set forth in the following claims.

I claim:

1. A boring bit comprising:

a shank including a first end and a second end, the shank defining a longitudinal axis extending through the first end and the second end; and a drilling head coupled to the first end of the shank coaxial with the longitudinal axis, the drilling head including a center tip extending axially along the longitudinal axis, and a pair of flanges extending radially outward from the center tip, each flange including a cylindrical sidewall section, a cutting edge extending radially outward from the center tip to the cylindrical sidewall section, a bottom face extending radially outward from the first end of the shank to the cylindrical sidewall section, a rake face extending axially from the cutting edge to the bottom face, a rearward edge extending radially outward from the first end of the shank to the cylindrical sidewall section and defining a boundary of the bottom face opposite the rake face, a spur spaced from the longitudinal axis and extending axially from the cylindrical sidewall section, and a chip channel defined at least in part by the cylindrical sidewall section to direct cut material away from the cutting edge and toward the shank;

wherein the cylindrical sidewall section of each flange extends through a sweep angle from the cutting edge to the rearward edge, the sweep angle being between about 30 degrees and about 60 degrees, wherein each flange further includes a trailing edge spaced from the cutting edge and extending radially outward from the center tip, a cutting face extending between the cutting edge and the trailing edge, and a relief face extending circumferentially away from the cutting face along the cylindrical sidewall section, and wherein each flange further includes a floor section forming the bottom face and a trailing face extending axially from the trailing edge to the floor section, and wherein the chip channel of each flange is defined by the trailing face, the cylindrical sidewall section, and the floor section.

2. The boring bit of claim 1, wherein the sweep angle of each flange is about 55 degrees.

3. The boring bit of claim 1, wherein the rake face of each flange is generally planar.

4. The boring bit of claim 3, wherein the cylindrical sidewall section of each flange is bounded by a plane at the cutting edge, wherein the rake face of each flange is oriented at a rake angle relative to the plane, and wherein the rake angle is between about 52 degrees and about 72 degrees.

5. A boring bit comprising:

a shank including a first end and a second end, the shank defining a longitudinal axis extending through the first end and the second end; and a drilling head coupled to the first end of the shank coaxial with the longitudinal axis, the drilling head including a center tip extending axially along the longitudinal axis, and a pair of flanges extending radially outward from the center tip, each flange including a cylindrical sidewall section, a cutting edge extending radially outward from the center tip to the cylindrical sidewall section, a bottom face extending radially outward from the first end of the shank to the cylindrical sidewall section, a rake face extending axially from the cutting edge to the bottom face, a trailing edge spaced from the cutting edge and extending radially outward from the center tip, a cutting face extending between the cutting edge and the trailing edge, a relief face extending circumferentially away from the cutting face along the cylindrical sidewall section, a rear face extending radially outward from the first end of the shank to the cylindrical sidewall section and extending axially from the bottom face to the relief face, a rearward edge extending radially outward from the first end of the shank to the cylindrical sidewall section through an intersection of the bottom face and the rear face, a spur spaced from the longitudinal axis and extending axially from the relief face, and a chip channel defined at least in part by the cylindrical sidewall section to direct cut material away from the cutting edge and toward the shank;

wherein the cylindrical sidewall section of each flange is generally smooth and continuous between the rake face and the rear face; and wherein the cylindrical sidewall section of each flange extends through a sweep angle from the cutting edge to the rearward edge, the sweep angle being between about 30 degrees and about 60 degrees such that the cylindrical sidewall section of each flange extends through between about 8% and about 17% of a total circumference of the drilling head.

6. The boring bit of claim 5, wherein the sweep angle of each flange is about 55 degrees such that the cylindrical sidewall section of each flange extends through about 15% of the total circumference of the drilling head.

7. The boring bit of claim 1, wherein the cylindrical sidewall section of each flange is bounded by a plane at the cutting edge, wherein the relief face of each flange is oriented at a relief angle relative to the plane, and wherein the relief angle is between about 12 degrees and about 21 degrees.

8. A boring bit comprising:

a shank including a first end and a second end, the shank defining a longitudinal axis extending through the first end and the second end; and a drilling head coupled to the first end of the shank coaxial with the longitudinal axis, the drilling head including a center tip extending axially along the longitudinal axis, and a pair of flanges extending radially outward from the center tip, each flange including a cylindrical sidewall section, a cutting edge extending radially outward from the center tip to the cylindrical sidewall section, a bottom face extending radially outward from the first end of the shank to the cylindrical sidewall section, a rake face extending axially from the cutting edge to the bottom face, a rearward edge extending radially outward from the first end of the shank to the cylindrical sidewall section and defining a boundary of the bottom face opposite the rake face, a spur spaced from the longitudinal axis and extending axially from the cylindrical sidewall section, and a chip channel defined at least in part by the cylindrical sidewall section to direct cut material away from the cutting edge and toward the shank;

wherein the cylindrical sidewall section of each flange extends through a sweep angle from the cutting edge to the rearward edge, the sweep angle being between about 30 degrees and about 60 degrees, wherein each flange further includes a trailing edge spaced from the cutting edge and extending radially outward from the center tip, a cutting face extending between the cutting edge and the trailing edge, and a relief face extending circumferentially away from the cutting face along the cylindrical sidewall section, and wherein the spur of each flange extends axially from the relief face, wherein a face of each spur nearest the cutting edge is oriented at a spur angle relative to the relief face, and wherein the spur angle is between about 88 degrees and about 98 degrees.

9. The boring bit of claim 1, wherein each flange further includes a rear face extending axially from the relief face to the bottom face, and wherein the rear face of each flange is generally planar.

10. The boring bit of claim 9, wherein the cylindrical sidewall section of each flange is bounded by a plane at the cutting edge, wherein the rear face of each flange is oriented at a rear face angle relative to the plane, and wherein the rear face angle is between about 90 degrees and about 105 degrees.

11. The boring bit of claim 1, wherein the bottom face of each flange is generally planar.

12. A boring bit comprising:

a shank including a first end and a second end, the shank defining a longitudinal axis extending through the first end and the second end; and a drilling head coupled to the first end of the shank coaxial with the longitudinal axis, the drilling head including a center tip extending axially along the longitudinal axis, and a pair of flanges extending radially outward from the center tip, each flange including a cylindrical sidewall section, a cutting edge extending radially outward from the center tip to the cylindrical sidewall section, a bottom face extending radially outward from the first end of the shank to the cylindrical sidewall section, a rake face extending axially from the cutting edge to the bottom face, a rear face extending radially outward from the first end of the shank to the cylindrical sidewall section and extending axially from the bottom face away from the first end of the shank, a spur spaced from the longitudinal axis and extending axially from a portion of the cylindrical sidewall section, and a chip channel defined at least in part by the cylindrical sidewall section to direct cut material away from the cutting edge and toward the shank;

wherein the cylindrical sidewall section of each flange is generally smooth and continuous between the rake face and the rear face; and wherein the cylindrical sidewall section of each flange extends through between about 8% and about 17% of a total circumference of the drilling head, and wherein each flange further includes a trailing edge spaced from the cutting edge and extending radially outward from the center tip, a cutting face extending between the cutting edge and the trailing edge, a floor section forming the bottom face, and a trailing face extending axially from the trailing edge to the floor section, and wherein the chip channel of each flange is defined by the trailing face, the cylindrical sidewall section, and the floor section.

13. The boring bit of claim 12, wherein the cylindrical sidewall section of each flange extends through about 15% of the total circumference of the drilling head.

14. The boring bit of claim 12, wherein the rake face of each flange is generally planar.

15. The boring bit of claim 12, wherein the bottom face of each flange is generally planar.

16. The boring bit of claim 12, wherein the rear face of each flange is generally planar.

17. The boring bit of claim 5, wherein the rake face, the bottom face, and the rear face of each flange are generally planar.

* * * * *